United States Patent [19]

Budzich

[11] Patent Number: 4,741,248

[45] Date of Patent: May 3, 1988

[54] LOAD RESPONSIVE SYSTEM HAVING SYNCHRONIZING SYSTEMS BETWEEN POSITIVE AND NEGATIVE LOAD COMPENSATION

[75] Inventor: Tadeusz Budzich, Moreland Hills, Ohio

[73] Assignee: Caterpillar Inc., Peoria, Ill.

[21] Appl. No.: 47,396

[22] Filed: May 8, 1987

[51] Int. Cl.[4] ..... F15B 13/02

[52] U.S. Cl. ..... 91/421; 91/446; 137/596.1; 137/596.13

[58] Field of Search ..... 91/421, 446; 137/596.1, 137/596.13

[56] References Cited

U.S. PATENT DOCUMENTS

| | | | |
|---|---|---|---|
| 3,858,393 | 1/1975 | Budzich | 60/427 |
| 4,058,140 | 11/1977 | Budzich | 137/596.13 |
| 4,222,409 | 9/1980 | Budzich | 137/596.13 |

*Primary Examiner*—Gerald A. Michalsky
*Attorney, Agent, or Firm*—J. W. Burrows

[57] ABSTRACT

A load responsive system is provided with two synchronizing systems for positive and negative load compensation. One of the synchronizing systems varies the flow through a negative load compensator, during control of a negative load, in response to the inlet pressure of a fluid motor which is controlled by a positive load compensator. The other synchronizing system isolates the system pump from the fluid motor during control of the negative load while make-up flow to the fluid motor is supplied from the fluid exhaust system. In a more specific arrangement, the system pump is isolated from the fluid motor through the use of the positive load compensator and totally independent of any negative load compensating action. The synchronizing systems function in response to an external signal(s), which can be a function of any selected specific parameter of the system.

36 Claims, 4 Drawing Sheets

10
10d
10a
W
10c
10b
11
11b
11c
11a
13
13a
13b
13c
13d
14
Sp
21
22
20
19
15a
15
16
SN
S
16a
17
18
18a
18b
18c
18d
18e
17a
12a
12
S2
S3
S4
S5
Sw 10
10b
10c
10a
W
Sw
89
10d
13
11b
13d
11a
11b
11a
32
29
25
27
26
28
A1
31
13a
35
23
34
33
88
34
35
11
13c
24
30
S2
A2
36
15
16
19
20
22
21
37
42
39
51
59
40
41
38
47
45
46
50
53
57
43
51a
58
16a
44
48
49
52
55
54
56
60
75
11a
78
A1
76
Sp
12a
A2
77
73
77
67
72
70
12
87
S3
68
66
74
65
S
69
91
86
S5
61
71
64
63
62
SN
S4
90
14
18
17
79
17a
80
81
82
83
84
85
S5
S4
S3
S2
Sw
11a

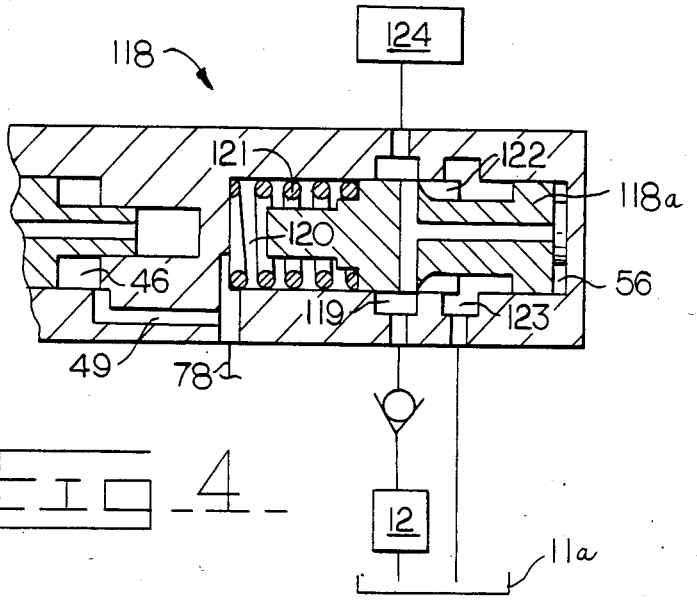
Fig. 4
Fig. 5
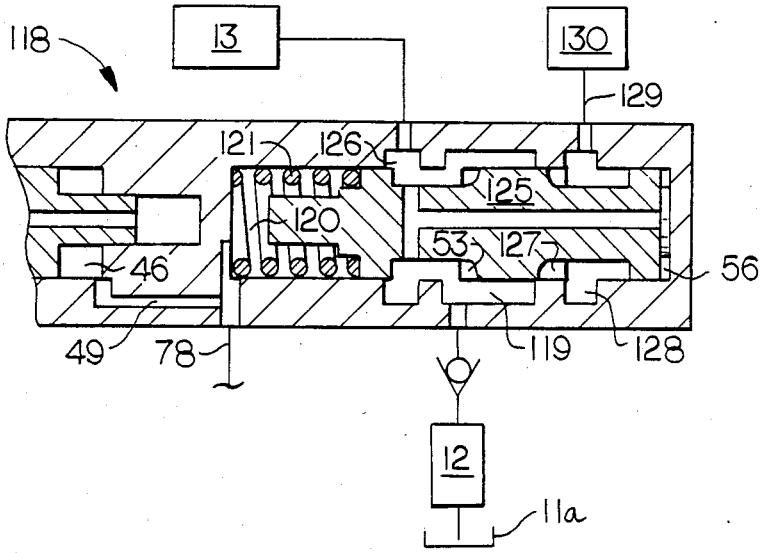

LOAD RESPONSIVE SYSTEM HAVING SYNCHRONIZING SYSTEMS BETWEEN POSITIVE AND NEGATIVE LOAD COMPENSATION

TECHNICAL FIELD

This invention relates generally to load responsive systems using positive load compensation and also systems using both positive and negative load compensation and more particularly to the synchronizing action of the positive and/or negative compensators during control of a negative load.

BACKGROUND OF THE INVENTION

Positive and negative load compensation is very desirable since it provides control of fluid flow to and from the fluid motor. This fluid flow is proportional to the displacement of the direction control spool from its neutral position, irrespective of the magnitude of the positive or negative loads being controlled. An example of such a system is shown in my U.S. Pat. No. 3,858,393 which issued June 7, 1975. This type of control suffers from one serious disadvantage. When using a cylinder as a fluid motor during control of a negative load, the cylinder can be subjected to excessive pressure at the cylinder outlet and to cavitation at the cylinder inlet. This system also is limited by the capacity of the pump, since in control of the negative load, the pump flow is being used thus limiting the ability of the pump to supply other system loads.

My U.S. Pat. No. 4,058,140 which issued Nov. 15, 1977 overcomes this drawback in part since, during control of a negative load, the system pump is isolated from the cylinder by the negative load compensation and the cylinder inlet flow is supplied from the pressurized exhaust system. Although this system is very efficient and increases the capability of the pump to perform work while a negative load is being controlled, it suffers from the disadvantage of comparatively low system response. This is especially prominent during the change of the system load from positive to negative.

The present invention is directed to overcoming one or more of the problems as set forth above.

DISCLOSURE OF THE INVENTION

In one aspect of the present invention, a load responsive system is provided having a valve assembly interposed between a fluid motor operable to control positive and negative loads and subjected to positive and negative load pressure, fluid exhaust means and a source of pressurized fluid. The system also has first valve means operable to selectively interconnect the fluid motor with the exhaust means and the source of pressurized fluid, isolating means operable to selectively isolate the source of pressurized fluid from the fluid motor, fluid replenishing means operable to interconnect the fluid motor and the exhaust means when the isolating means is activated, logic means operable to determine whether the fluid motor is subjected to negative or positive load pressure, positive load pressure throttling means between the fluid motor and the source, and negative load pressure throttling means between the fluid motor and the exhaust means. The negative load pressure throttling means includes throttling means and variable outflow orifice means. The system further includes control means of the negative load pressure throttling means, first regulating means of the throttling action of the throttling member means in the control means operable to control the flow of fluid through any selectable flow area of the variable outflow orifice means at a relatively constant flow level independent of the magnitude of the negative load pressure, control signal generating means of the isolating means having generator means responsive to a control signal from various control elements of the system and operative during control of the negative load fluid flow from the source to the fluid motor can be selectively interrupted without deactivation of the negative load pressure throttling means, and second regulating means in the control means of the negative load pressure throttling means having means responsive to the positive load pressure and operable to increase the fluid flow through the variable outflow orifice means with an increase in the positive load pressure during control of the negative load.

In another aspect of the subject invention, a load responsive system is provided having a valve assembly interposed between a fluid motor operable to control positive and negative loads and subjected to positive and negative load pressure, fluid exhaust means and a source of pressurized fluid, first valve means operable to selectively interconnect the fluid motor with the exhaust means and the source of pressurized fluid, isolating means operable to selectively isolate the source of pressurized fluid from the fluid motor, and fluid replenishing means operable to interconnect the fluid motor and the exhaust means when the isolating means is activated. The system further includes logic means operable to determine whether the fluid motor is subjected to negative or positive load pressure, positive load pressure throttling means including the isolating means between the fluid motor and the source of pressurized fluid, and variable outflow orifice means between said fluid motor and said exhaust means, said variable outflow orifice means including valve means of the isolating means having piston means responsive to a control signal from a control signal generating means whereby during control of the negative load, fluid flow from the source of pressurized fluid to the fluid motor can be selectively interrupted in response to the control signal.

BRIEF DESCRIPTION OF THE DRAWINGS

FIG. 4 illustrates a partial sectional view of a positive load compensator of a bypass type with other system components shown schematically; and FIG. 5 illustrates a partial sectional view of a positive load compensator of a throttling and bypass type for use in series type circuits, with other system components shown schematically.

DESCRIPTION OF THE PREFERRED EMBODIMENTS

Figure 1:
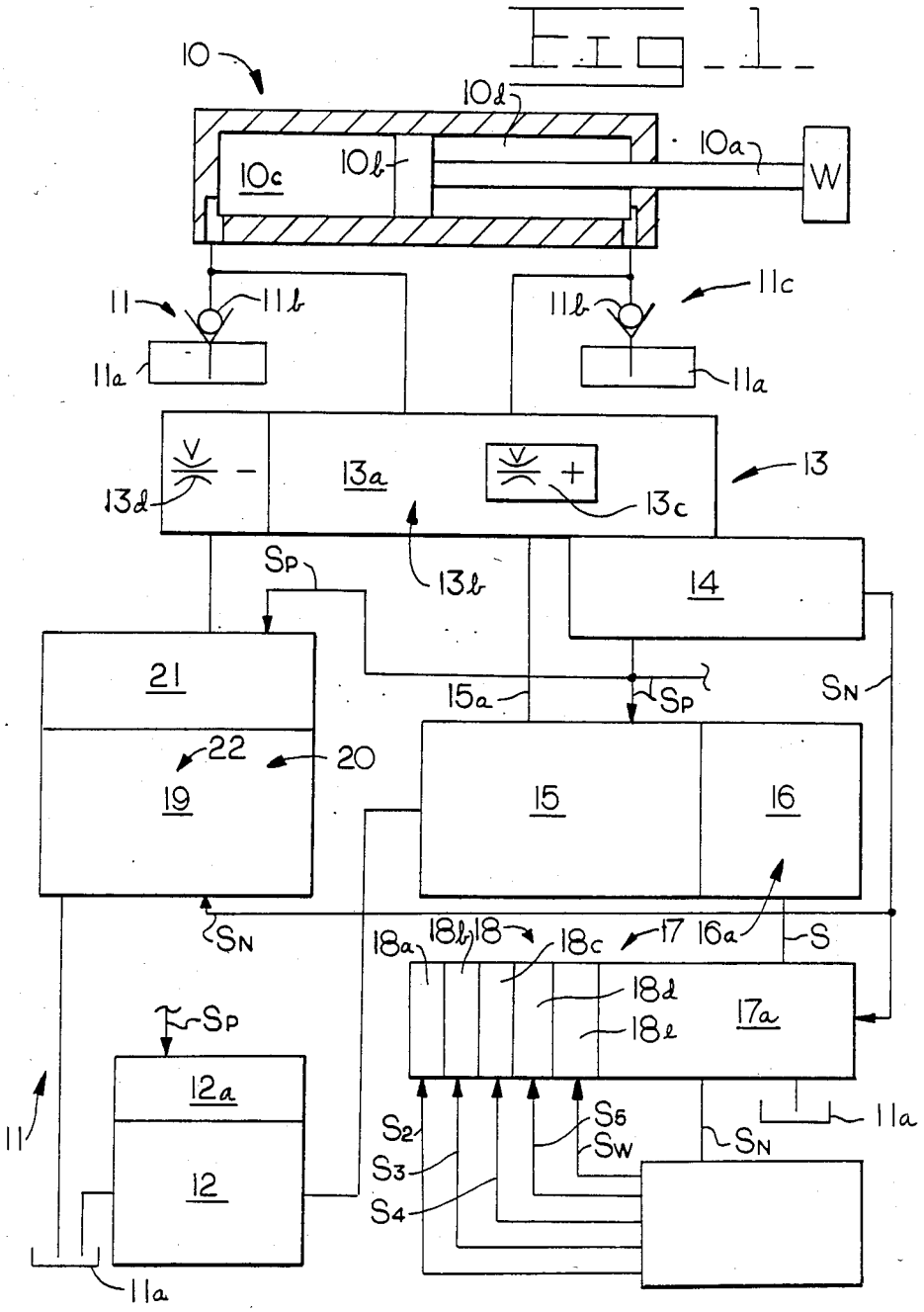
FIG. 1 is a diagram which illustrates both schematically and diagrammatically the basic concept of the present invention.

Referring now to FIG. 1, a load responsive system is shown. The system includes a fluid motor 10, shown in this embodiment as being of a cylinder type and in a well known manner controls the speed and position of a load W. The load W is connected by piston rod 10*a* to piston 10*b* which functionally divides the cylinder into two chambers 10*c*, 10*d*. Fluid exhaust means 11 which includes a system reservoir 11*a* is used to provide fluid to a source of pressurized fluid, such as a pump 12. The pump 12 is connected to a first valve means 13, such as a direction control valve 13*a*, which includes variable flow orifice means 13*b*. The variable flow orifice means 13*b* includes variable inflow orifice means 13*c* operable to control the flow into the fluid motor 10 and variable outflow orifice means 13*d* operable to control the flow out of the fluid motor 10. The cylinder chambers 10*c*, 10*d* are connected, in a well known manner, through make-up valves 11*b* with the system reservoir 11*a* to constitute replenishing means 11*c*.

Logic means 14, well known in the art, is associated with the cylinder chambers 10*c*, 10*d* and the first valve means 13 and can take many forms, but essentially establishes whether the controlled load W is positive or negative.

Positive load pressure throttling means 15, used in compensation of positive loads and well known in the art, is connected by a fluid conducting line 15*a* to the variable inflow orifice means 13*c* and upstream thereof. The positive load pressure throttling means 15, in a well known manner, throttles the fluid flow from the source 12 of pressurized fluid to maintain a relatively constant pressure differential across the variable inflow orifice means 13*c* in response to a signal $S_p$ transmitted from the logic means 14. The positive load pressure throttling means 15 is provided with an isolating means 16 which is operable to selectively isolate the source 12 of pressurized fluid from the fluid motor 10 when the first valve means 13 is controlling a negative load.

Isolating means 16 can be independently actuated by the transmission of a control signal S from a control signal generating means 17 usually in the form of a 3-way valve 17*a*. The control signal generating means 17 responds to generator means 18 which is composed of individual signal generators 18*a*, 18*b*, 18*c*, 18*d*, 18*e* in response to respective control signals $S_2$, $S_3$, $S_4$, $S_5$, $S_w$ which are generated by various sensors or transducers from various control elements of the hydraulic system.

Negative load pressure throttling means 19 is connected to the first valve means 13 downstream thereof and includes the variable outflow orifice means 13*d*. A control means 20 of the negative load pressure throttling means 19 is made responsive to the positive load pressure signal $S_p$ and a negative load pressure signal $S_n$ which is also transmitted from the logic means 14.

A regulating means 21 is associated with the negative load pressure throttling means 19 and is adapted to control movement of a negative load pressure compensator or throttling member means 22 of the negative load pressure throttling means 19.

As is well known in the art, the source 12 of pressurized fluid can be either a variable or a fixed displacement type pump and the positive load pressure signal $S_p$ from the logic means 14 would be applied to an output flow control 12*a*. The output flow control 12*a* may be of the pressure compensated or bypass type.

Figure 2:
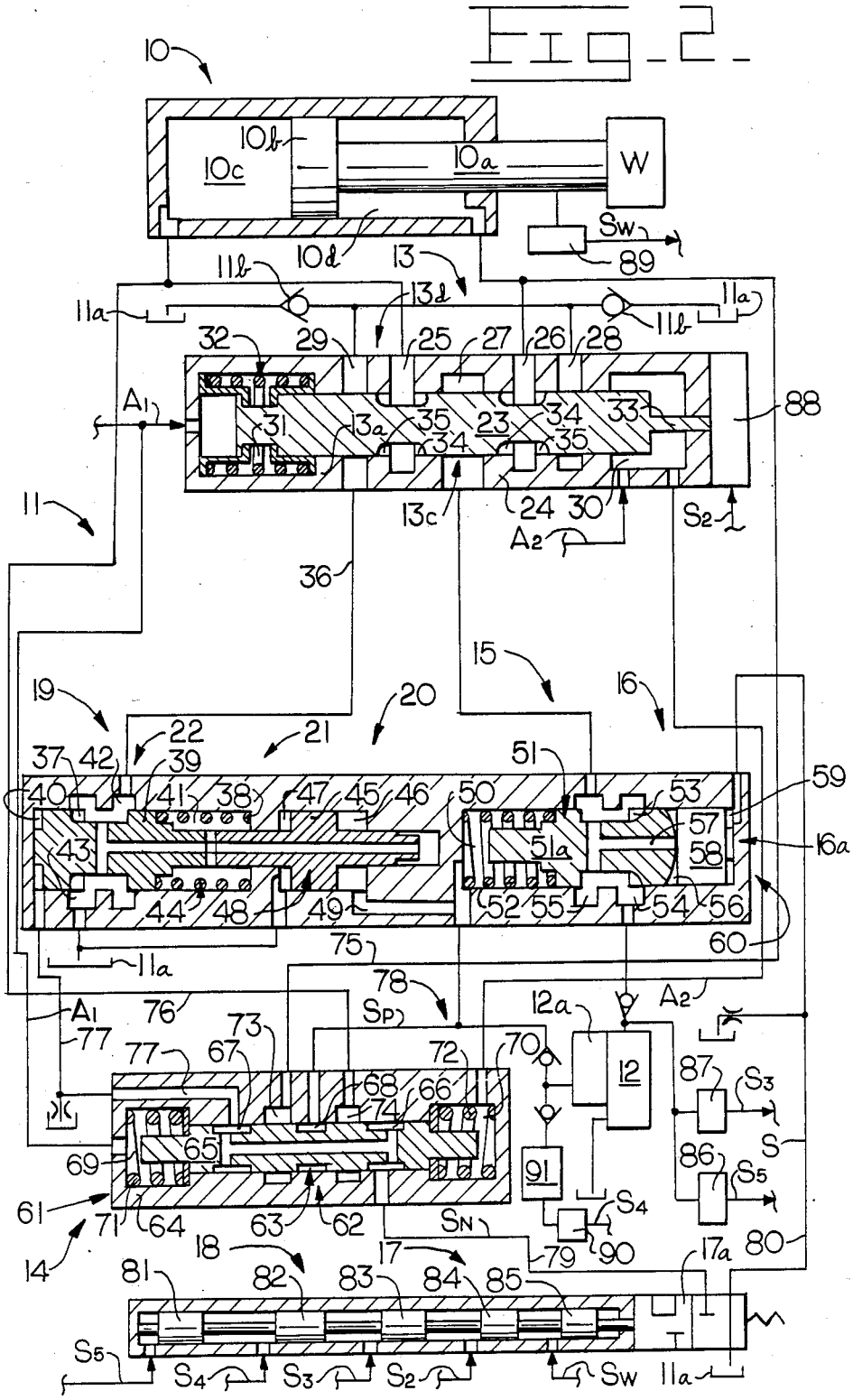
FIG. 2 illustrates a load responsive system having a single stage compensated direction control valve, pressure compensated controls, and load pressure signal identifying and transmitting valve all shown in cross section with the remainder of the system schematically shown and incorporating an embodiment of the present invention.

Referring now to FIG. 2, the direction control valve 13*a* is interposed between the fluid motor 10 and the control circuit which includes the pump 12 and the fluid exhaust means 11. The control valve 13*a* has a directional control spool 23, slidably guided in a housing 24, whioh is provided with load chambers 25, 26, supply chamber 27, exhaust chambers 28,29, and control chambers 30,31. The control spool 23 is biased towards the position as shown by a centering spring assembly 32. The control spool 23 protrudes with its ends into the control chambers 30 and 31 and is provided with negative load pressure or variable outflow orifice means 13*d* and positive load pressure or variable inflow orifice means 13*c*. The end of the direction control spool 23, protruding into the control chamber 30, is provided with extension 33, connected to the control signal generating means 17, which can take many forms, like for example a hydraulic signal generator or any type of signal generator responsive to the position of the direction control spool 23, which generates the signal $S_2$ in response to the change in position of the direction control spool 23. Metering slots 34 make up the variable inflow orifice means 13*c* while metering slots 35 make up the variable outflow orifice means 13*d*. Movement of the control spool 23 is accomplished by directing pressurized fluid into the control chambers 31, 30 through the respective pilot lines $A_1$, $A_2$.

The exhaust chambers 28 and 29 are interconnected for one-way fluid flow by make-up valves 11*b* to the system reservoir 11*a*, while also being connected through a line 36 to the throttling member means 22 of the negative load pressure throttling means 19. The throttling member means 22 is provided with throttling port means 37 and biased towards the position shown by control spring 38. Throttling member means 22 includes a throttling spool 39 subjected to negative load pressure in a control chamber 40 and an intermediate negative load pressure, smaller than negative load pressure by a control pressure differential, in a control chamber 41 for selectively throttling fluid flow from an outlet chamber 42 to an exhaust chamber 43. The regulating means 21 includes first regulating means 44 which may be in the form of the throttling member means 22.

Control means 20 of negative load pressure throttling means 19 is provided with a differential piston 45, which selectively engages the throttling spool 39 and is operable to increase the pressure differential across the negative load pressure throttling means 19 and therefore increasing fluid flow through the negative load pressure throttling means 19. The differential piston 45 is subjected on its annular unbalanced area, to the positive load pressure existing in a control chamber 46, while a control chamber 47 is connected to the system reservoir 11*a*. Control pressure differential adjusting means 48 constitutes a second regulating means and includes the annular area of the differential piston 45, subjected to positive load pressure in the control chamber 46, which is connected by passage 49 with a control chamber 50.

Positive load pressure throttling means 15 includes a positive load pressure compensator 51 and the variable inflow orifice means 13*c*. The positive load pressure compensator 51 includes a compensator spool 51*a* which is subjected on one end to the positive load pressure in the control chamber 50 and biased by a control spring 52. The compensator spool 51*a* is provided with throttling ports 53 to selectively throttle fluid flow between an inlet chamber 54 and a supply chamber 55.

The positive load pressure compensator 51 protrudes into a control chamber 56, connected by a passage 57 with the supply chamber 55 and selectively engages a free floating piston 58. The free floating piston 58 protrudes into a control chamber 59 and is subjected on its cross-sectional area to the pressure in the control chamber 59, which is selectively connected to either negative load pressure or system reservoir 11*a*. The force generated by the negative load pressure on the cross-sectional area of the free floating piston 58 by the negative load pressure constitutes a force generating means 60.

Logic means 14 includes external logic means 61, provided with means operable to identify positive and negative load pressure 62, which in turn includes positive load pressure identifying means 63.

External logic means 61 comprises a housing 64, provided with a bore guided signal identifying shuttle 65, which defines annular spaces 66 and 67 subjected to negative load pressure and annular space 68 which is subjected to positive load pressure. Movement of the signal identifying shuttle 65 is controlled in response to the presence of $A_1$ and $A_2$ pressure signals in the control chambers 69 and 70 and the centering force of springs 71 and 72. Chambers 73 and 74 are respectively connected by fluid lines 75, 76 to the cylinder chambers 10*d*, 10*c* of the fluid motor 10. Annular space 67, subjected to negative load pressure, is connected through a transmitting means 77 to the control chamber 40. Annular space 68, subjected to positive load pressure, is connected by means operable to transmit positive load pressure signal 78 with control chambers 46,50, and the output flow control 12*a*. Annular space 66, subjected to negative load pressure, is connected by line 79 to the three-way valve 17*a*, which selectively communicates the negative load pressure through line 80 to the control chamber 59. The three-way valve 17*a* responds to the control signal generating means 17 of isolating means 16, which includes free floating pistons 81,82,83,84 and 85, which are subjected to control pressure signals $S_5$, $S_4$, $S_3$, $S_2$ and $S_w$.

$S_5$ pressure signal is generated by a pressure signal generator 86 in response to the pump output pressure being above a certain minimum predetermined pressure level, $S_3$ pressure signal is generated by pressure signal generator 87 in response to the pump output pressure being below a certain minimum predetermined level, $S_2$ pressure signal is generated by means 88 responsive to position of direction control spool 23, $S_w$ signal is generated by a signal generator 89, which is a transducer responsive to the position of the load W. $S_4$ is a pressure signal generated by a signal generator 90 from a pressure signal originating in another circuit designated as 91.

In response to $A_1$ or $A_2$ control pressure signals, the direction control spool 23 is proportionally displaced, creating metering orifices between load chamber 25 or 26 and the supply chamber 27 and exhaust chamber 29 and 28, the metering orifice through the variable outflow orifice means 13*d* passing the fluid flow from the fluid motor 10, while the metering orifice, through the variable inflow orifice means 13*c*, passes the fluid flow to the fluid motor 10.

In response to $A_1$ or $A_2$ pressure signal, the signal identifying shuttle 65 will be displaced from its neutral position in either direction, connecting the negative load annular space 67 or 66 and positive load annular space 68, either to chamber 73 or 74. The direction of the displacement of the signal identifying shuttle 65, together with the existence of pressure in the chamber 73 or 74, will determine whether the load pressure is positive or negative, with the identified load pressure signal automatically being transmitted to the positive load pressure throttling means 15 and the negative load pressure throttling means 19.

If a positive load is being controlled by the direction control spool 23, the compensator spool 51*a*, with its throttling ports 53, will assume a modulating position throttling the fluid flow from the inlet chamber 54 to the supply chamber 55 to maintain a relatively constant pressure differential across the positive load variable inflow orifice means 13*c*. The load W at any one time can only be positive or negative. Consequently, during control of positive load, the negative load pressure signal is zero and therefore the control chamber 59 is subjected to very low negative load pressure with the free floating piston 58 being fully displaced to the right as shown in FIG. 2. The resulting displacement of the piston 10*b* in turn results in flow out of the fluid motor 10, through the variable outflow orifice means 13*d* to the fluid exhaust means 11 with the outlet chamber 42 and the exhaust chamber 43 being interconnected by the throttling spool 39. Since the control chamber 46 of the control means 20 is also subjected to positive load pressure, the force developed by the positive load pressure on the effective area of the differential piston 45 will transmit a force to the throttling spool 39, forcibly maintaining it in a fully open position as shown in FIG. 2.

If the controlled load W is negative, the external logic means 61 connects the negative load pressure to the control chamber 40, activating the negative load pressure throttling means 19 which, by throttling ports means 37 throttles fluid from the outlet chamber 42 to the exhaust chamber 43 to maintain a relatively constant pressure differential across the variable outflow orifice means 13*d*.

Assume that the negative load is being controlled from the cylinder chamber 10*c*, with the outflow of the fluid motor 10, due to the well known piston rod effect, being greater than the inflow into cylinder chamber 10*d*. As is well known in the art, with outflow out of the fluid motor 10 being greater than the inflow, the negative load pressure will be increased to a very high level by the energy supplied from the pump 12, subjecting the fluid motor 10 to excessive pressures and creating a positive load pressure effect in the cylinder chamber 10*d*. This positive load pressure effect will result in generation of a force by the control pressure differential adjusting means 48, which supplements the biasing force of the control spring 38 and effectively increases the level of the controlled pressure differential across the variable outflow orifice means 13*d*. This variable pressure differential effect will automatically regulate the flow out of the fluid motor 10 in response to pressure of the inflowing fluid to the fluid motor 10, synchronizing the action of the positive and negative load compensators 51,22 and preventing generation of excessive pressures during control of the negative load.

The synchronization between positive and negative load compensators 51,22 can also be accomplished by isolating the pump 12 from the fluid motor 10 during control of negative load. Then, during control of the negative load the negative load pressure throttling means 19 automatically maintains a constant pressure differential across the variable outflow orifice means 13*d* while the inflow into the fluid motor 10 is supplied from the system reservoir 11*a*, in a well known manner, through the make-up valves 11*b*.

When using the second method of synchronization between the positive and negative load compensators 51,22, the compensator spool 51*a* of the positive load compensator 51 is fully displaced from right to left by the free floating piston 58, subjected to pressure in the control chamber 59. Therefore, by the action of the three-way valve 17*a*, the control chamber 59 can be connected with the annular space 66 in the external logic means 61. Since, during control of negative load, the annular space 66 is automatically subjected to negative load pressure, the positive load pressure compensator 51 is automatically displaced all the way from right to left, through the action of the free floating piston 58, isolating the system pump 12 from the fluid motor 10.

Therefore, during control of negative load, synchronization between positive and negative load compensation, will take place either at a variable pressure differential, through the action of the differential piston 45, or through the principle of so-called negative load regeneration, induced by the isolating action of the free floating piston 58. This second method of synchronization, during control of negative load, can be selectively introduced by the action of the three-way valve 17*a* in response to control signal $S_w$, $S_2$, $S_3$, $S_4$ or $S_5$. These control signals will automatically generate a force through the action of the free floating pistons 81,82,83,84 or 85 which is proportional to the control signals. Since signals $S_w$, $S_2$, $S_3$, $S_4$ and $S_5$ can be generated in response to the control action of various control elements of the circuit, the synchronizing action of negative load regeneration can be selectively introduced in response to any specific condition existing in the control circuit.

Since synchronization between positive and negative load compensation, through using the principle of negative load regeneration, saves in flow output of the pump, during control of negative load, it is very efficient, but its response is not as fast as that when synchronization by variation in control pressure differential is used. Therefore selective use of those two types of synchronization in response to a specific duty cycle of the fluid power and control system produces new, unobvious and very beneficial results.

Figure 3:
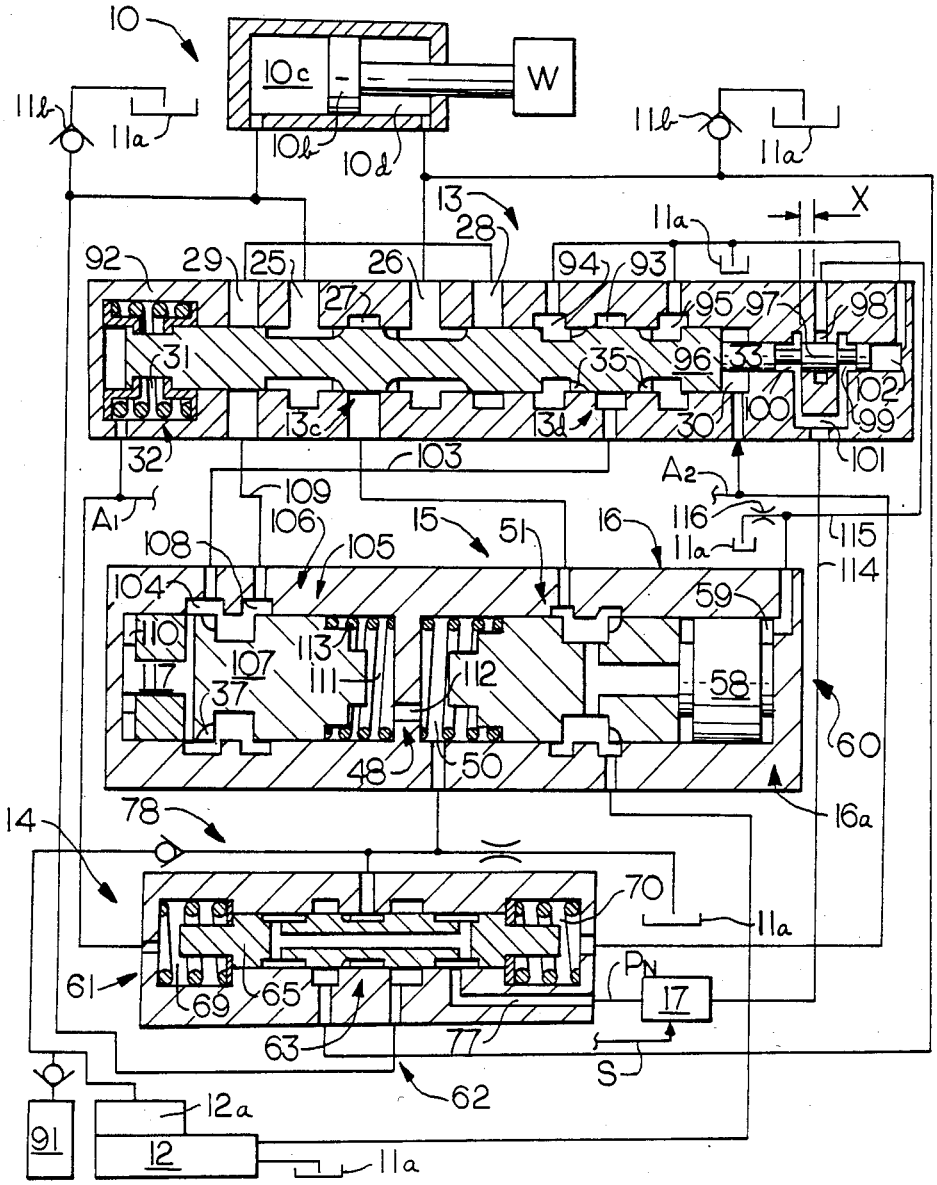
FIG. 3 illustrates a load responsive system incorporating another embodiment of the present invention.

Referring now to FIG. 3, the embodiment of the control system of FIG. 2 from a functional standpoint is very similar to that of FIG. 3, like components being designated by like numerals.

Control signal generating means 17, schematically shown in FIG. 3, can be identical and can contain the same control components as that of FIG. 2 and may include the three-way valve assembly 17*a*. The external logic means 61 and the positive load pressure throttling means 15 which are functionally interconnected to the isolating means 16 of FIG. 2 and FIG. 3 are identical. The first valve means 13 of FIGS. 2 and 3 are similar, although in FIG. 3 a housing 92 is provided with an additional outlet chamber 93 and first and second exhaust chambers 94 and 95, which are connected to system reservoir 11*a*. The variable inflow orifice means 13*c* is located on a direction control spool 96, similar to the direction control spool 23 of FIG. 2, between the supply chamber 27 and the load chambers 25 and 26. Variable outflow or negative load pressure orifice means 13*d* is located between the outlet chamber 93 and the first and second exhaust chambers 94 and 95. The extension 33 of the direction control spool 96 is provided with a land 97 functionally isolating, in the position shown in FIG. 3, a signal chamber 98 from annular chambers 99 and 100, which are interconnected by a core passage 101. The end of extension 33 protrudes into a chamber 102 which is vented to system reservoir 11*a*. The outlet chamber 93 is connected by a fluid line 103 with an inlet chamber 104 of means 105 operable to control pressure upstream of outflow fluid metering orifice means 13*d*. Means 105, which in the embodiment of FIG. 3, is in the form of a reducing valve 106 performs a function very similar to that of the negative load pressure throttling means 19 of FIG. 2, which is shown in FIG. 2 in the form of a negative load pressure compensator 22. Means 105 is provided with a pressure reducing spool 107, provided with throttling port means 37, operable to throttle fluid flow between the inlet chamber 104 and an outlet chamber 108, which is connected by line 109 with exhaust chambers 28 and 29. One end of the pressure reducing spool 107 protrudes into a control chamber 10, while the other end protrudes into the control chamber 111 connected through passage 112 with the control chamber 50. The pressure reducing spool 107 is biased by a control spring 113 and is provided with control pressure adjusting means 48, which constitutes the force generated on the cross-sectional area of the pressure reducing spool 107 by the positive load pressure existing in the control chamber 111. The core passage 101 of the housing 92 is connected by a fluid conducting line 114 to the control signal generating means 17, while the signal chamber 98 is connected through a leakage orifice 116 to the system reservoir 11*a*.

As described when referring to FIG. 2, control of the positive load W of FIG. 3 is identical to that of FIG. 2. With the inflow into the fluid motor 10, in a well known manner, being controlled by the combination of the throttling action of the positive load compensator 51 and the metering action of the variable inflow orifice means 13*c*, while the outflow from the fluid motor 10 is conducted from exhaust chambers 28 and 29 through the outlet chamber 108 to the inlet chamber 104, which in turn is connected through line 103, the outlet chamber 93 and the metering slots 35 of the variable outflow orifice means 13*d* to one of the first and second exhaust chambers 94 and 95, which in turn are connected to the system reservoir 11*a*.

During control of negative load, the control action of the positive load compensator 51 and the control action of the pressure reducing spool 107 are synchronized in the following way.

With high negative load pressure being transmitted from the fluid motor 10 to the control chamber 110 through outlet chamber 108, the inlet chamber 104 and a passage 117 and with the control chamber 111 being subjected to very low positive load pressure, the pressure reducing spool 107 will assume a modulating position to throttle, by throttling port means 37, fluid flow from the outlet chamber 108 to the inlet ohamber 104 to automatically maintain the inlet chamber 104 at a constant pressure level, equivalent to the preload of the control spring 113. If due to the throttling action of the positive load compensator 51, the pressure of the fluid flowing into the fluid motor 10 would start to rise, automatically increasing the pressure in the control chamber 111, the controlled pressure level, as will be evident to those skilled in the art, will proportionally increase in the inlet chamber 104. Since the inlet chamber 104 is connected by line 103 to the outlet chamber 93, the pressure upstream of the variable outflow orifice means 13*d* will vary in an identical manner. Therefore, for any specific orifice of the variable outflow orifice means 13*d*, created by displacement of the direction control spool 96, fluid flow through the variable outlet orifice means 13*d* can be regulated by the change in the controlled pressure level of the pressure reducing spool 107. Through this synchronizing action, the difference between the fluid inflow and outflow of the fluid motor 10 is automatically compensated for during control of the negative load without generation of excessive pressures in the fluid motor 10 by the energy derived from the system pump 12. This synchronizing action, between positive and negative load compensation of FIG. 3, which is accomplished by variation in control pressure upstream of the variable outflow orifice means 13*d* is similar to the synchronizing action of FIG. 2, in which the synchronizing action is accomplished by variation in the level of the control pressure differential of the negative load compensator 22, across the variable outflow orifice means 13*d*.

By introduction of the feature of negative load regeneration, in an identical manner as described when referring to FIG. 2, through the action of the isolating means 16, a different type of synchronizing action between the positive and negative load compensating controls 51,22 can be obtained. This synchronizing action, through negative load regeneration, is accomplished by connecting control chamber 59 with the negative load pressure generated during control of negative loads, which in a manner as previously described when referring to FIG. 2, through the action of the free floating piston 58, by repositioning the positive load compensator 51, isolates the system pump 12 from the fluid motor 10.

In the embodiment of FIG. 3, the control chamber 59 is selectively connected to the negative load pressure by displacement of the land 97 of the spool extension 33, which connects the core passage 101 with the signal chamber 98. In this way, switching from one type of synchronization to the other becomes a function of the displacement of the direction control spool 96.

In FIG. 3 during the movement of the displacement control spool 96, within distance X, synchronization between positive and negative load compensation will be accomplished, in a manner as described above, by variation in the control pressure level upstream of the variable outflow orifice means 13*d*.

Once displacement of the direction control spool 96 exceeds the distance X, the negative load pressure is automatically connected to the signal chamber 98 and the control chamber 59,moving the positive load compensator 51 all the way from right to left, isolating the pump 12 from the fluid motor 10 and automatically imposing, in a manner as previously described, synchronization through negative load regeneration, in which the control pressure upstream of the variable outflow orifice means 13*d* is maintained at a constant level, irrespective of the variation in the magnitude of the negative load W.

In a fully compensated valve, during control of negative load, the flow out of the fluid motor 10 is directly proportional to the displacement of the direction control spool 96 from its neutral position.

Therefore, in the embodiment of FIG. 3, during small displacements of the valve spool 96, synchronization between positive and negative load compensating controls will be done through variation in the control pressure level upstream of the variable outflow orifice means 13*d*, while the fluid inflow into the fluid motor 10 is controlled by the positive load compensator 51 from the system pump 12, providing a control system, characterized by lower efficiency with higher response characteristics of the controls.

At higher controlled flow levels, corresponding to larger displacement of the direction control spool 96, synchronization through negative load regeneration will be automatically introduced, providing a system characterized by high efficiency, but slower response of the controls.

Referring now to FIGS. 4 and 5, the output flow control 12*a* of FIG. 1 is incorporated with the positive load pressure compensator 51 to provide a bypass means 118 which in FIG. 4 includes a throttling bypass member 118*a* and in a well known manner maintains a constant pressure differential between the pressure in an inlet chamber 119 and a control chamber 120, which is connected through means 78 to the positive load pressure identifying means 63 of the external logic means 61 of FIGS. 2 and 3. The level of the constant pressure differential is dictated by the preload in a control spring 121 and is controlled by the throttling action of throttling bypass slots 122, diverting the flow from the system pump 12 to an exhaust chamber 123 and to the reservoir 11*a*. The fluid flow at a controlled pressure level is directed from the inlet chamber 119 to a schematically shown control circuit 124.

In FIG. 5, the bypass means 118 includes a throttling and bypass member 125 and in a well known manner maintains a constant pressure differential between a second fluid supply chamber 126 and the control chamber 120, which is supplied with fluid at positive load pressure through line 78 from the positive load pressure identifying means 63 of the external logic means 61 of FIGS. 2 and 3. The control of the pressure differential is obtained either through the throttling action of the throttling slots 53 or through the bypass action of bypass and throttling slots 127. The bypass and throttling action of the bypass and throttling slots 127 permits the excess flow from the pump 12 to be passed to a bypass chamber 128, which is connected in series by line 129 with a series power circuit 130 or to the another circuit 91 set forth in FIGS. 2 and 3. With the positive load control of FIG. 5, the first valve means 13, connected to second fluid supply chamber 126, has an automatic flow priority over the control valves of the series circuit 130, since only excess flow, over that required by the first valve means 13, can be passed to the series circuit 130.

As previously mentioned, synchronization between the positive and negative load controlling circuits, by isolating the pump 12 from the fluid motor 10 during control of negative load, is very desirable, since it not only increases to a great extent the system efficiency, but what is more important, saves on the pump flow, extending the capability of the pump to perform useful work. Synchronization of the positive load compensator 51 with negative load controlling circuit is not only of importance, when using negative load compensation, but is also beneficial when using just an uncompensated variable orifice, positioned on the direction control spool 23, while controlling negative load, since even with this combination the fluid motor 10, in the form of a cylinder, can be subjected to excessive pressures, while controlling a negative load, through the use of energy derived from the system pump 12.

When using positive load compensation only and when controlling more than one load at a time, the introduction of negative load regeneration, in control of the fluid motor 10 controlling a negative load, in response to an external control signal, will produce new, unobvious and beneficial results, increasing the system efficiency, extending the capability of the pump 12 to perform useful work and speeding up the work cycle.

The external control signal, to activate negative load regeneration, can be a function of a number of system parameters, but it becomes especially useful when responding to the signal, which results from the pump 12 reaching its maximum output capacity. Since activation of negative load regeneration uses the energy derived from the negative load, irrespective of the presence of the external control signal, it cannot take place unless the negative load is being controlled.

Introduction of negative load regeneration in control of negative load at a point, at which the pump 12 reaches its maximum outflow capacity, not only saves the pump flow for simultaneous control of other system loads, but also permits control of negative load at velocities much higher than those, equivalent to the maximum flow output of the system pump. During negative load regeneration, the inflow to the fluid motor 10 is provided from the fluid exhaust means 11 or exhaust manifold, which in a well known manner, can be maintained at a sufficiently high pressure level to permit filling of the fluid motor without cavitation.

Activation of negative load regeneration, in a system using positive load compensation only, must only take place if the load is sufficiently large to permit its control in response to the command signal. If the negative load is not large enough to perform the function in the required time, the energy of the negative load must be supplemented by that derived from the system pump. Therefore, in any specific system the external signal, activating negative load regeneration, must not take place below a certain minimum predetermined negative load pressure level. Since in the systems of the embodiments of this invention the negative load pressure activates isolating means 16, the free floating piston 58 can be made responsive to the negative load pressure above a certain predetermined level, by a change in the preload of control spring 52, or by a change in the cross-sectional area of the free floating piston 58, or by a selection of the effective area of the free floating piston 58 and the preload of the control spring 52, which preload determines the control pressure differential of the positive load pressure compensator 51.

Other aspects, objects and advantages of this invention can be obtained from a study of the drawings, the disclosure and the appended claims.

I claim:

1. A load responsive system comprising:

a valve assembly interposed between a fluid motor operable to control positive and negative loads and subjected to positive and negative load pressure, fluid exhaust means and a source of pressurized fluid, first valve means operable to selectively interconnect said fluid motor with said exhaust means and said source of pressurized fluid, isolating means operable to selectively isolate said source of pressurized fluid from said fluid motor, fluid replenishing means operable to interconnect said fluid motor and said exhaust means when said isolating means is activated, logic means operable to determine whether said fluid motor is subjected to negative or positive load pressure, positive load pressure throttling means between said fluid motor and said source, negative load pressure throttling means between said fluid motor and said exhaust means, said negative load pressure throttling means including throttling member means and variable outflow orifice means, control means of said negative load pressure throttling means, first regulating means of the throttling action of said throttling member means in said control means operable to control the flow of fluid through any selectable flow area of said variable outflow orifice means at a relatively constant flow level independent of the magnitude of said negative load pressure, control signal generating means of said isolating means having generator means responsive to a control signal from various control elements of the system whereby during control of said negative load fluid flow from said source to said fluid motor can be selectively interrupted without deactivation of said negative load pressure throttling means, and second regulating means in said control means of said negative load pressure throttling means having means responsive to said positive load pressure and operable to increase fluid flow through said variable outflow orifice means with increase in said positive load pressure during control of said negative load.

2. The system as set forth in claim 1 wherein said isolating means has force generating means operably connected to said positive load pressure throttling means.

3. The system as set forth in claim 2 wherein said force generating means is responsive to said negative load pressure.

4. The system as set forth in claim 2 wherein said force generating means has a free floating piston.

5. The system as set forth in claim 1 wherein said replenishing means includes make-up valves operable to interconnect for one way fluid flow said fluid exhaust means and said fluid motor.

6. The system as set forth in claim 1 wherein said control signal generating means has valve means operable to selectively interconnect said isolating means with said exhaust means and said negative load pressure.

7. The system as set forth in claim 1 wherein said control signal generating means has means responsive to the position of said first valve means.

8. The system as set forth in claim 1 wherein said control signal generating means has means responsive to the position of said first valve means and valve means operable to selectively interconnect said isolating means with said exhaust means and said negative load pressure.

9. The system as set forth in claim 1 wherein said control signal generating means has spool extension means responsive to the flow output from said source of pressurized fluid.

10. The system as set forth in claim 1 wherein said control signal generating means has generator means responsive to the pressure of said source of pressurized fluid above a certain minimum predetermined level.

11. The system as set forth in claim 1 wherein said control signal generating means has generator means responsive to the pressure of said source of pressurized fluid below a certain minimum predetermined level.

12. The system as set forth in claim 1 wherein said control signal generating means has generator means responsive to the position of said load.

13. The system as set forth in claim 1 wherein said control signal generating means has generator means responsive to a control input from another control circuit.

14. The system as set forth in claim 1 wherein said positive load pressure throttling means includes fluid bypass means interposed between said source of pressurized fluid and said fluid exhaust means.

15. The system as set forth in claim 14 wherein said bypass means includes fluid throttling slots interposed between said source of pressurized fluid and said first valve means and fluid bypass slots interposed between said source and a series power circuit.

16. The system as set forth in claim 1 wherein said second regulating means is a controlled pressure differential adjusting means operable to increase said pressure differential acting across said variable outflow orifice means with an increase in said positive load pressure.

17. The system as set forth in claim 1 wherein said second regulating means has control pressure adjusting means operable to increase said control pressure upstream of said variable outflow orifice means with an increase in said positive load pressure.

18. The system as set forth in claim 1 wherein said first regulating means has throttling port means positioned down stream of said variable outflow orifice means and throttling member means operable to maintain a relatively constant pressure differential across said variable outflow orifice means while the up stream pressure of said throttling port means is permitted to vary with the variation in said negative load pressure.

19. The system as set forth in claim 1 wherein said first regulating means has throttling port means positioned upstream of said variable outflow orifice means and means operable to control pressure upstream of said variable outflow orifice means independent of the variation in said negative load pressure.

20. The system as set forth in claim 1 wherein said positive load pressure throttling means includes variable inflow orifice means.

21. The system as set forth in claim 1 wherein said positive load pressure throttling means includes variable inflow orifice means and a positive load pressure compensator upstream of said variable inflow orifice means, said positive load pressure compensator having a compensator spool operable to control the pressure differential across said variable inflow orifice means at a relatively constant preselected level.

22. The system as set forth in claim 1 wherein said logic means has positive load pressure identifying means operable to identify the presence of said positive load pressure and a transmitting means operable to transmit the control signal of said identified positive load pressure to said positive load pressure throttling means and to said second regulating means of said control means of said negative load pressure throttling means.

23. The system as set forth in claim 22 wherein said source of pressurized fluid has an output flow control responsive to said positive load pressure and said transmitting means is operable to transmit the control signal of said identified positive load pressure to said output flow control of said source of pressurized fluid.

24. The system as set forth in claim 1 wherein logic means has means operable to identify the presence of said positive and said negative load pressure, transmitting means operable to transmit the control signal of said identified positive load pressure to said positive load pressure throttling means and to said second regulating means, and another transmitting means operable to transmit the control signal of said identified negative load pressure to a control chamber of said negative load pressure throttling means.

25. A load responsive system, comprising:

a valve assembly interposed between a fluid motor operable to control positive and negative loads and subjected to positive and negative load pressure, fluid exhaust means and a source of presurized fluid, first valve means operable to selectively interconnect said fluid motor with said exhaust means and said source of presureized fluid, isolating means operable to selectively isolate said source of pressurized fluid from said fluid motor, fluid replenishing means operable to interconnect said fluid motor and said exhaust means when said isolating means is activated, logic means operable to determine whether said fluid motor is subjected to negative or positive load pressure, positive load pressure throttling means including said isolating means and located between said fluid motor and said source of pressurized fluid, variable outflow orifice means located between said fluid motor and said exhaust means, control signal generating means operable to selectively provide a control signal, said control signal generating means has valve means operable to provide said control signal by selectively interconnecting said isolating means with said exhaust means or siad negative load pressure, and actuating means of said isolating means responsive to the control signal from the control signal generating means whereby during control of said negative load fluid flow from said source of pressurized fluid to said fluid motor can be selectively interrupted in response to said control signal.

26. The system as set forth in claim 25 wherein said isolating means has force generating means operably connected to said positive load pressure throttling means.

27. A valve assembly as set forth in claim 26 wherein said force generating means has piston means responsive to said negative load pressure.

28. The system as set forth in claim 25 wherein said isolating means has piston means responsive to said negative load pressure.

29. The system as set forth in claim 25 wherein said actuating means has a free floating piston responsive to said negative load pressure.

30. The system as set forth in claim 25 wherein said replenishing means includes make-up valves operable to interconnect for one way fluid flow said fluid exhaust means and said fluid motor.

31. The system as set forth in claim 25 wherein said valve means of said control signal generating means is responsive to the position of said first valve means.

32. The system as set forth in claim 25 wherein said control signal generating means has means responsive to position of said first valve means and valve means operable to selectively interconnect said isolating means with said exhaust means and said negative load pressure.

33. The system as set forth in claim 25 wherein said control signal generating means has generator means responsive to the pressure of said source below a certain minimum predetermined level.

34. The system as set forth in claim 25 wherein said control signal generating means has generator means responsive to the pressure of said source of pressure above a certain minimum predetermined level.

35. The system as set forth in claim 25 wherein said control signal generating means has generator means responsive to the position of said load.

36. The system as set forth in claim 25 wherein said signal generating means has generating means responsive to a control input from another control circuit.

* * * * *